US012778190B1

(12) United States Patent
Sternberg

(10) Patent No.: US 12,778,190 B1
(45) Date of Patent: Nov. 3, 2026

(54) MOUTHPIECE FOR HOLDING ITEMS FOR SMOKING

(71) Applicant: Jesse Sternberg, Cutler Bay, FL (US)

(72) Inventor: Jesse Sternberg, Cutler Bay, FL (US)

( * ) Notice: Subject to any disclaimer, the term of this patent is extended or adjusted under 35 U.S.C. 154(b) by 545 days.

(21) Appl. No.: 18/462,644

(22) Filed: Sep. 7, 2023

Related U.S. Application Data

(63) Continuation-in-part of application No. 17/676,120, filed on Feb. 19, 2022, now Pat. No. 12,616,241.

(60) Provisional application No. 63/197,147, filed on Jun. 4, 2021, provisional application No. 63/151,395, filed on Feb. 19, 2021.

(51) Int. Cl.
*A24D 3/18* (2006.01)

(52) U.S. Cl.
CPC ..... *A24D 3/18* (2013.01)

(58) Field of Classification Search
None
See application file for complete search history.

(56) References Cited

U.S. PATENT DOCUMENTS

2016/0235118 A1* 8/2016 Riederer ..... A24F 7/00
2022/0015416 A1* 1/2022 McKnight ..... A24C 5/476

FOREIGN PATENT DOCUMENTS

CN 1081853 A * 2/1994

OTHER PUBLICATIONS

CN1081853A Discription English Translation obtained from Espacenet, pp. 1-6 (Year: 2024).*

* cited by examiner

*Primary Examiner* — Philip Y Louie
*Assistant Examiner* — Virginia R Bieger
(74) *Attorney, Agent, or Firm* — Charles T. Riggs, Jr.

(57) ABSTRACT

A mouthpiece for holding the tip of an item to be smoked has a passageway comprising a narrow tubular section at one end and a wider conical section at another end. Therebetween, the passageway has at least one stepped portion. Internal threads are optionally provided on the conical section. The mouthpiece provides for holding various sized items to be smoked.

6 Claims, 6 Drawing Sheets

Figure 6B
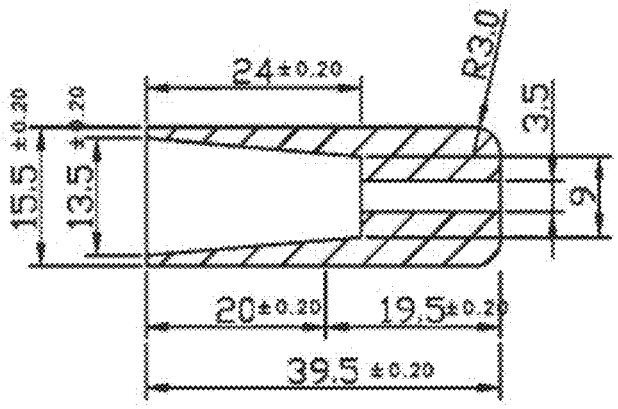
Figure 6C
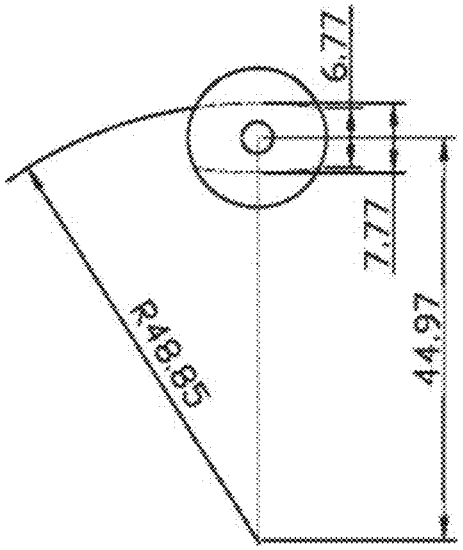
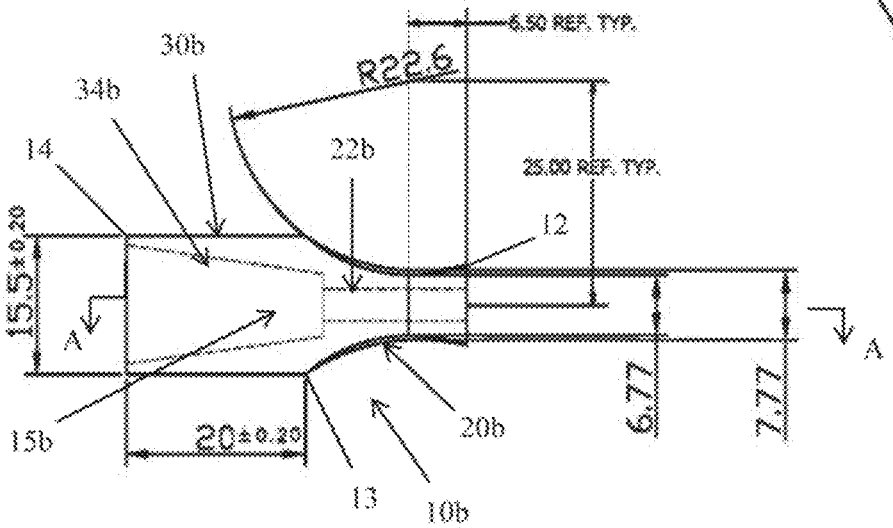
Figure 6A

MOUTHPIECE FOR HOLDING ITEMS FOR SMOKING

RELATED APPLICATIONS

This application is a Continuation-In-Part of U.S. patent application Ser. No. 17/676,120, entitled Mouthpiece Holder for Smoking, filed Feb. 19, 2022, which also relates to and claims priority to U.S. provisional patent application No. 63/151,395 entitled Mouthpiece Holder for Smoking, filed Feb. 19, 2021, and U.S. provisional patent application No. 63/197,147 entitled Mouthpiece Holder for Smoking, filed Jun. 4, 2021, the entire disclosures of which are incorporated herein.

BACKGROUND

Cigarette holders with mouthpieces have a long history, and were popularly used decades ago as a fashion accessory in the form of a slender tube in which a cigarette was held for smoking. Today, mouthpieces for holding items to be smoked, such as cigarettes, cigars and rolled marijuana joints, are typically much shorter tips used for more practical reasons.

With the legalization of marijuana in many locations, smokers often roll their own joints. This results in various, custom sized joints. However, existing mouthpieces are a fixed size and cannot adequately hold different sized joints or other items to be smoked. Known mouthpiece "cigarette" holders are basically a nine millimeter cylinder, so unless the user can roll their cigarette or joint to fit precisely in a 9 mm hole, they do not offer much usefulness to the user. A typical joint will have a diameter of 6-8 mm. A pre-rolled cone for tobacco or marijuana typically has the smallest diameter at 4 mm to 5 mm. The biggest end diameter in a joint tends to be no more than 9 mm, although it is possible to roll large ends which some people do.

Accordingly, to address and overcome the inefficiencies, limitations and disadvantages of existing mouthpiece tip holders described above, an improved mouthpiece tip holder is needed which can hold various sized items to be smoked, and which provides for easy sharing of items to be smoked. The mouthpiece tip holder(s) disclosed herein fulfills such needs.

SUMMARY

The present disclosure relates to mouthpieces for holding items to be smoked. In particular, the present invention relates to mouthpieces for holding the tip of an item to be smoked, such as a cigarette, cigar or rolled marijuana joint. Specifically, the present disclosure related to universal sized mouthpiece tip holders for holding custom rolled marijuana joints and self-rolled cigarettes of various sizes, which can both quickly and easily receive and release virtually every size marijuana joint or self-rolled cigarette.

BRIEF DESCRIPTION OF DRAWINGS

FIG. 6A is a phantom side view of another alternate embodiment of the mouthpiece tip holder of the present disclosure.

FIG. 6B is a cross-sectional view of mouthpiece tip holder of FIG. 6A.

FIG. 6C is an end view of mouthpiece tip holder of FIG. 6A.

DETAILED DESCRIPTION

Figure 1:
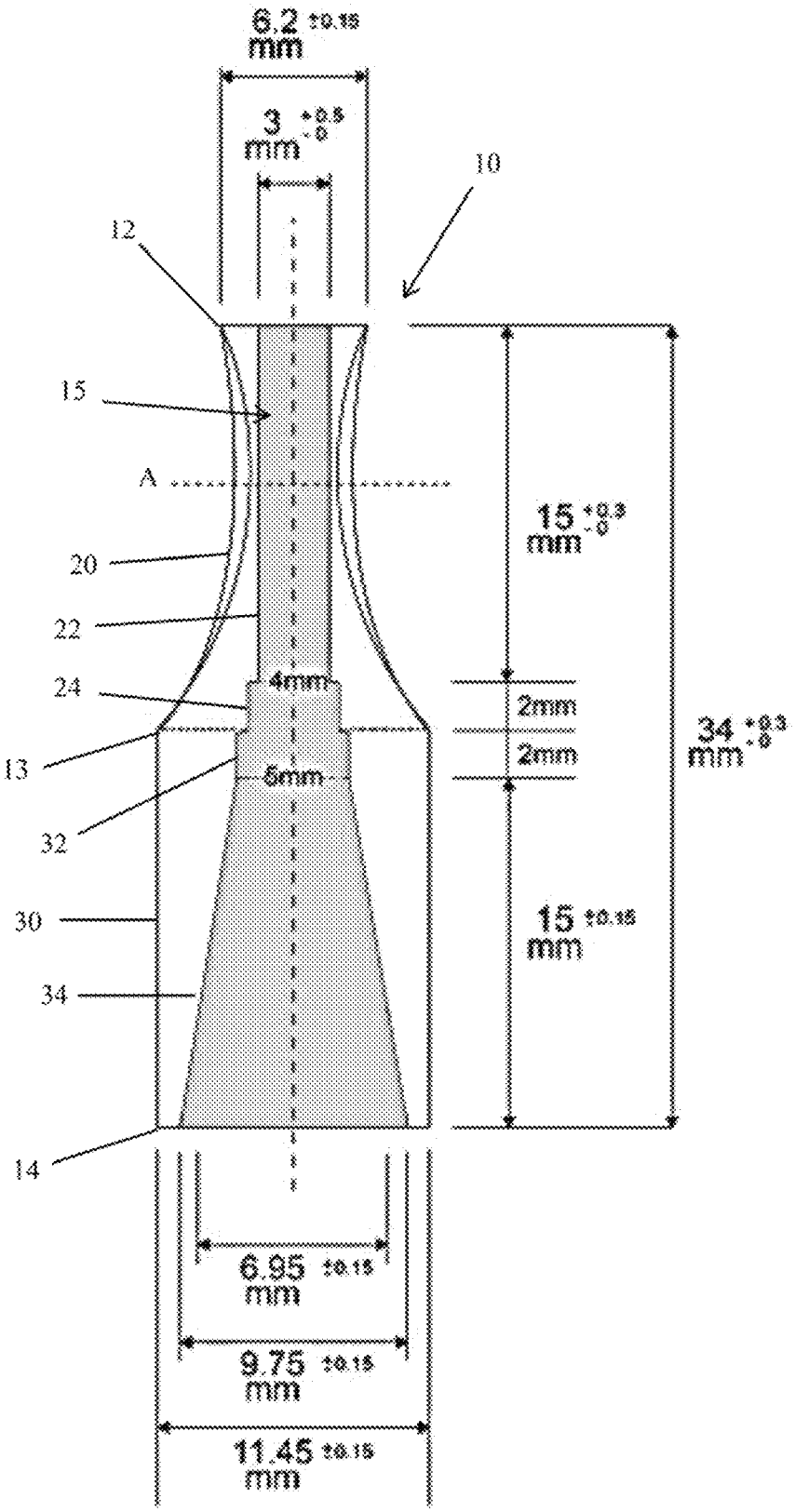
FIG. 1 is a phantom size view of the mouthpiece tip holder of the present disclosure.

As can be seen in the drawing FIGS. 1-5, the mouthpiece 10 has a first end 12 and a second end 14. The first end 12 is intended to be placed into or against a user's mouth when smoking. The second end 14 is intended to receive the tip of an item to be smoked.

Figure 2:
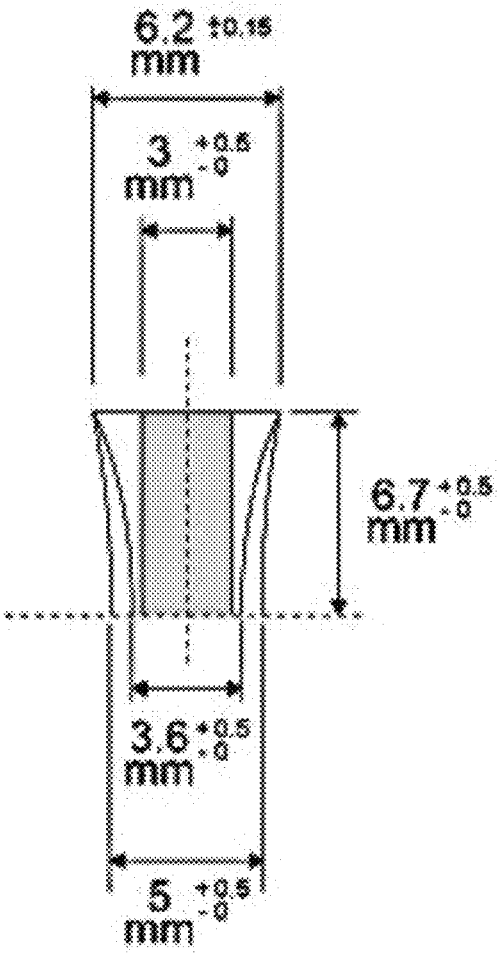
FIG. 2 is an enlarged partial phantom side view of FIG. 1.
Figure 3:
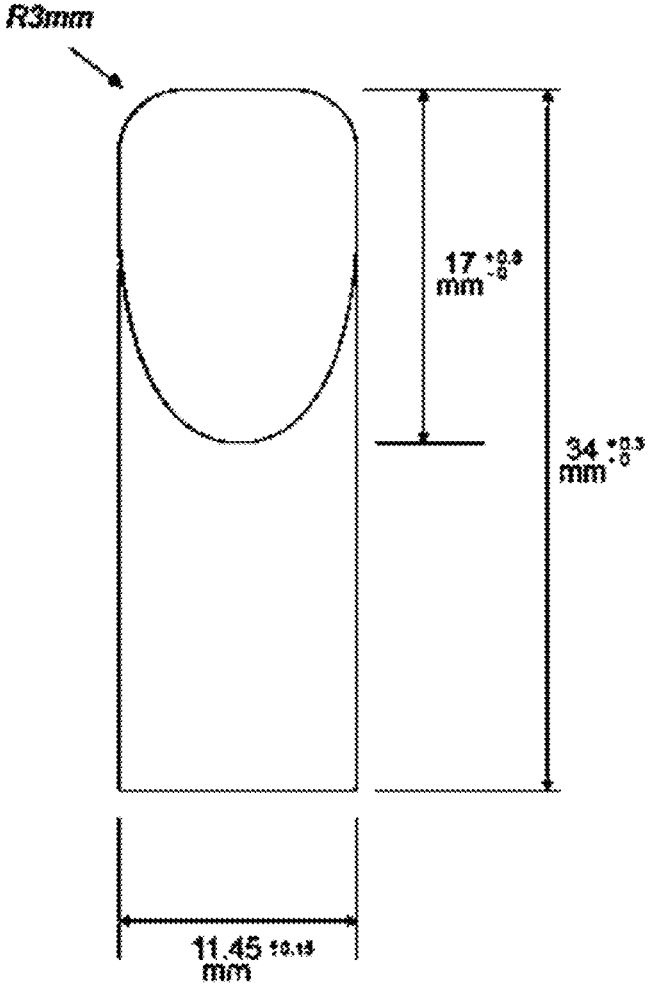
FIG. 3 is a top view of the mouthpiece tip holder of the present disclosure.

As illustrated in FIGS. 1-3, the mouthpiece 10 has a first section 20 and a second section 30. Both the first section 20 and the second section 30 of the mouthpiece 10 preferably have a length of 17 mm. The second section 30 is a generally tubular portion with an outside diameter of preferably 11.45 mm, and an inside diameter of 9.75 mm at end 14. The first section 20 is a generally curved, flatted section of the mouthpiece 10. As can be seen in FIG. 3, both sections preferably have a width of 11.45 mm. As can be seen in the side view of FIG. 1, the first section 20 slopes longitudinally from the midpoint of the mouthpiece 10 downward to a thin portion preferably having a height of 3.6 mm at section line A, as best seen in FIG. 2, and then sloping back upwards to end 12 where it preferably has a height of 6.2 mm. As also can be seen in FIGS. 1 and 2, section 20 is also concave and also slopes laterally from a height of 3.6 mm at its center along section line A outward towards its sides shown in FIG. 2, where it has a preferred height at its sides of 5 mm at section line A. This concave shape provides a curved gripping area which assists a user in securely grasping the mouthpiece between the user's thumb underneath and forefinger on top.

As also illustrated in FIGS. 1-3, mouthpiece 10 has a longitudinal passageway 15 therethrough, as defined by passageway sections 22, 24, 32 and 34. Passageway sections 22 and 24 are in first mouthpiece section 20, and passageway sections 32 and 34 are in second mouthpiece section 30. Passageway section 22 is generally tubular having a 3 mm diameter, and preferably extends 15 mm from end 12 toward midsection 13. Passageway section 24 is generally tubular and steps outward from passageway section 22 to a diameter of preferably 4 mm, and extends for preferably 2 mm the rest of the way to midsection 13, as can be seen. Passageway section 32 is generally tubular and steps outward from passageway section 24 to a diameter of preferably 5 mm, and preferably extends another 2 mm from midsection 13 toward end 14. Passageway section 34 is generally conical and extends outward from passageway section 32 to a diameter of preferably 9.75 mm, and extends for preferably 15 mm the rest of the way to end 14, as can be seen. In this embodiment, the conical surface of passageway section is smooth.

In use, the user simply inserts the tip of the item to be smoked which adequate pressure to press fit the item into the conical interior of the mouthpiece 10. Preferably, the user twists the item between 90 degrees and 180 degrees to assist in achieving the proper press fit. In this manner, a universal fit is achieved by the passageway shape to securely hold the items of various sizes between approximately 3 mm and 9.75 mm. From joints to cones to blunts, the mouthpiece is designed to allow them to be inserted with a twist, and a snug fit is achieved regardless as to whether the end is 3 mm up to 9.75 mm. It should be understood that if the item to be smoked is a tubular or conical shape having a tip diameter of approximately 3 mm, it can be held in at least passageway section 22. If the item to be smoked is a tubular or conical shape having a diameter of approximately 4 mm, it can be held in at least passageway section 24. If the item to be smoked is a tubular or conical shape having a diameter of approximately 5 mm, it can be held in at least passageway section 32. If the item to be smoked is a tubular or conical shape, or other non-uniform shape, having a portion with a width or height greater than 5 mm, it can be held in passageway section 34.

The passageway of the mouthpiece 10 is thus designed to hold anything from a pre-rolled cone with a 3 mm wide tip to a large hand-rolled cigarette with a 9.75 mm tip and everything in between. The user simply inserts the end of the item to be smoked into the mouthpiece and gives it a twist while pushing in to assure a tight snug fit within the mouthpiece.

To remove the item to be smoked from the mouthpiece, the user simply pulls on the item until the press fit is overcome by force, thereby releasing the item. The user can also twist the item while pulling to help overcome the press fit force. Accordingly, the mouthpiece device will make it safe for users to share the same item to be smoked, e.g., to share a joint, blunt or rolled cigarette.

Accordingly, the mouthpiece 10 allows users to pass a joint amongst multiple people and do it safely by each person having their own mouthpiece. The first user can insert the item to be smoked into their mouthpiece, smoke the item, and then take it out and pass it to the next user having their own mouthpiece. In this manner, there is no passing of saliva, germs, etc. This also serves as just a better, cleaner way for each person to smoke.

Figure 4:
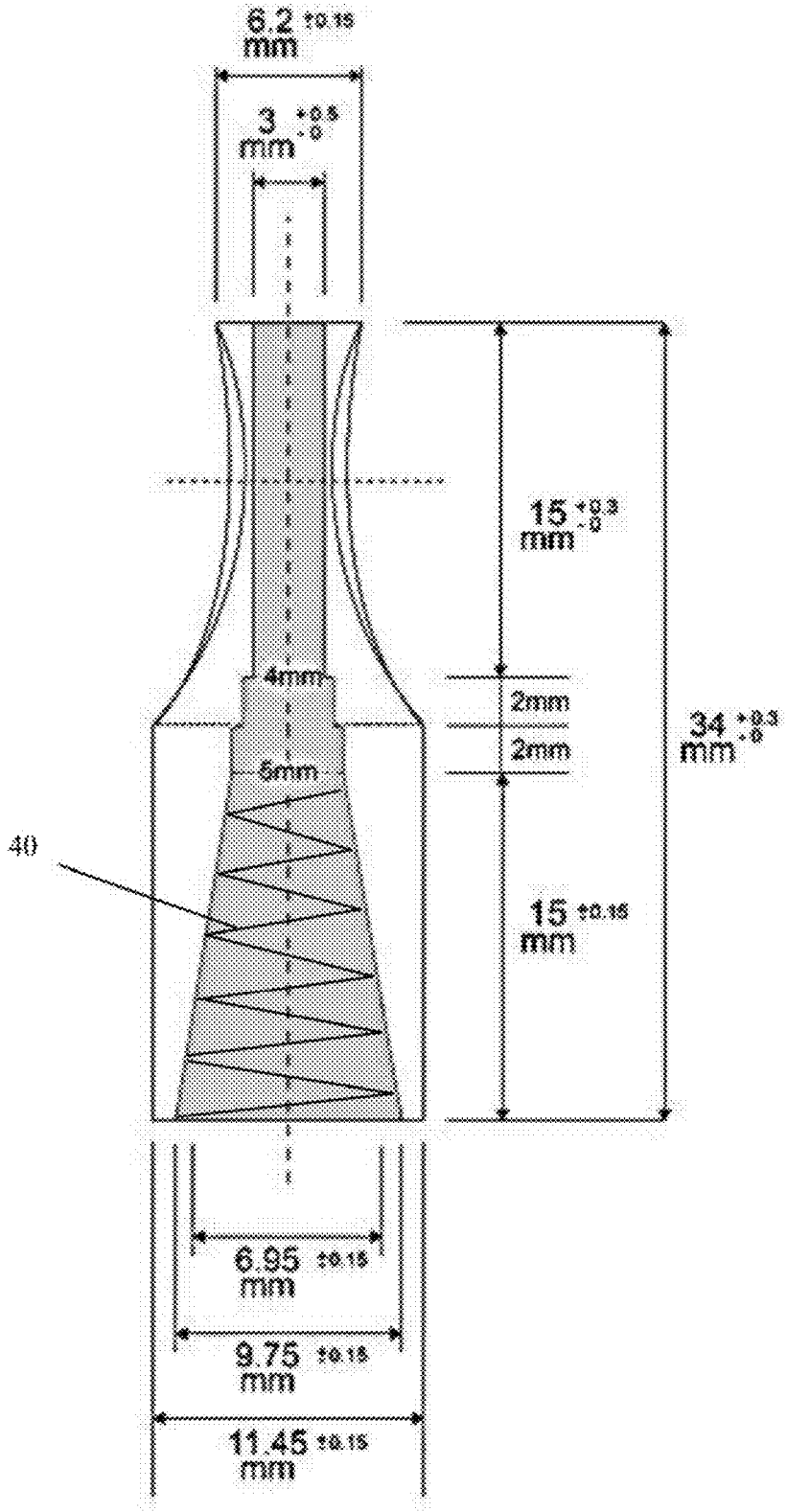
FIG. 4 is a phantom size view of the mouthpiece tip holder of FIG. 1 with internal threads.

Referring now to FIG. 4, an alternate embodiment is shown which is similar to the embodiment described in FIGS. 1-3, except that there are internal threads 40 inside the cone shaped passageway section 34. The threads preferably run from the 9.75 mm opening at end 14 down to the 5 mm end at section 32 in a few thread revolutions, such as approximately 2-4 revolutions. The user will simply twist the item to be smoked, having a diameter between 5 mm and 9.75 mm, into the cone section 34, and it will become screw fitted securely therein, and held by the threads 40.

Figure 5:
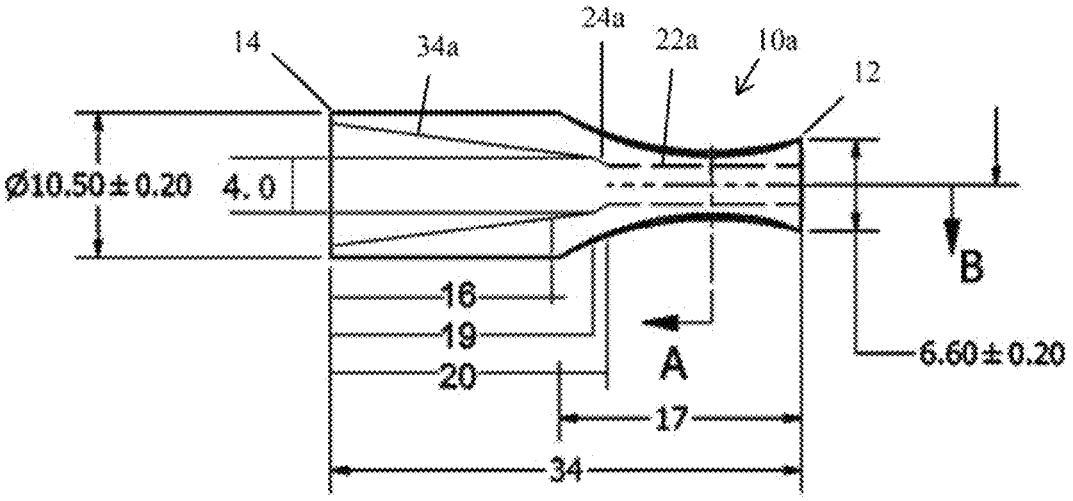
FIG. 5 is a phantom size view of an alternate embodiment of the mouthpiece tip holder of the present disclosure.

FIG. 5 illustrates another alternate embodiment of the mouthpiece 10*a*. In this embodiment, the passageway only has three sections. The first passageway section 22*a* is 14 mm long, from end 12 to the second passageway 24*a*. The second passageway section 24*a* is 1 mm long and angles outward instead of a step, from first passageway 22*a* to the conical passageway 34*a*. The conical passageway section 34*a* is 19 mm long, extending from second passageway section 24*a* to end 14. The height of the mouthpiece 10*a* at end 12 is preferably 6.6 mm. The height of the mouthpiece 10 at end 14 is preferably 10.5 mm at its outside diameter, with an inside diameter of about 8.9 or 9 mm. The diameter of second passageway 24*a* is preferably 4 mm at its conical section 34*a* end, and 3 mm to 3.5 mm at its first section 22*a* end. In use, the item to be smoked is press fit into the mouthpiece 10*a* as described above. Optionally, threads may be provided on conical section 34*a*. The embodiment of FIG. 5 holds pre-rolled cones and hand-rolled joints with ends from about 3.5 or 4 mm to 8.9 mm. Alternatively, mouthpiece 10*a* can have only two sections by eliminating section 24*a* and providing a step outward in the passageway from the first section to the second section.

In another alternate embodiment illustrated in FIG. 6A-6C, the mouthpiece 10*b* holds joints and blunts with ends ranging from 9 mm to 13.5 mm. In this embodiment, the passageway only has two sections. FIG. 6A is a side view of mouthpiece 10*b*. FIG. 6B is a cross-sectional view of mouthpiece 10*b* taken along arrows A-A. FIG. 6C is an end view of mouthpiece 10*b*.

As can be seen in FIGS. 6A-6C, the mouthpiece 10*b* has a longitudinal passageway 15*b* therethrough, as defined by passageway sections 22*b* and 34*b*. Passageway section 22*b* is in mouthpiece section 20*b*. Passageway section 22*b* is generally tubular having a 3.5 mm diameter, and preferably extends 15.5 mm from end 12 toward midsection 13*b*. At its opposite end, passageway section 22*b* steps outward to a diameter of preferably 9 mm, where conical passageway section 34*b* meets passageway 22*b*. Passageway section 34*b* extends at an angle from the step for preferably 4 mm (linear) to midsection 13, and continues at the same angle another 20 mm (linear) from midsection 13 to end 14, as can be seen. At end 14, passageway section 32*b* has a diameter of preferably 13.5 mm. In this embodiment, the conical surface of passageway section 34*b* is smooth. Optionally, threads may be provided on conical section 34*b*.

The height of the mouthpiece 10*b* at end 12 is preferably 7.77 mm, and slopes downward to 6.77 mm towards the center of mouthpiece section 22*b*, before sloping back upward to meet at second mouthpiece section 30*b*. The height of the mouthpiece 10*b* at end 14 is preferably 15.5 mm at its outer diameter, with an inside diameter of 13.5 mm. In use, the item to be smoked is press fit into the mouthpiece 10*a* as described above.

In general, the mouthpiece of the present disclosure will have a passageway defining a generally tubular section, and a conical section, and optionally with one or more stepped and/or angled out sections therebetween. The tubular section may have a spherical cross-sectional shape, or may have another cross-sectional shape such as that of an oval. It should be understood that the dimensions discussed herein may be altered slightly without departing from the spirit and scope of the present disclosure, so long as the mouthpiece will function in the manner described herein. Preferably, the dimensions may be altered between plus or minus one mm.

Preferably, the mouthpieces disclosed herein are wooden. Additionally, the mouthpiece can be made of any suitable material, such as plastic, metal, wood, or the like. Also, the mouthpiece may have a filter within the passageway in one of the sections, preferably section 22.

It should be understood that the components of the device(s) or product(s) disclosed herein can take any suitable form, including any suitable materials or components capable of adequately performing their respective intended functions, as may be known in the art. Further, while the embodiment(s) are illustrative of the structure, function and operation of the exemplary device(s) or product(s), it should be understood that various modifications may be made thereto without departing from the teachings herein.

While the foregoing has described what are considered to be the best mode and/or other examples, it is understood that various modifications may be made therein and that the subject matter disclosed herein may be implemented in various forms and examples, and that the product(s) and devices(s) may be applied in numerous applications, only some of which have been described herein.

What is claimed is:

1. A device for holding the tip of an item to be smoked, comprising:

a mouthpiece formed from a single piece of material and having:

a first mouthpiece section having a concaved top side, a concaved bottom side, and a tubular first passageway section defining a first length, wherein the tubular first passageway section has a diameter of 3.5 mm; and a tubular second mouthpiece section having a conical second passageway section defining a second length, wherein the conical second passageway section has a first end diameter of 9 mm and a second end diameter of 13.5 mm.

2. The device of claim 1, wherein the length of the first passageway is 15.5 mm, and the linear length of the second passageway is 24 mm.

3. The device of claim 1, wherein the mouthpiece provides for holding various sized items with ends ranging from 9 mm to 13.5 mm.

4. The device of claim 1, wherein the first mouthpiece section has a top side and a bottom side, and wherein each side has a concave shape.

5. A device for holding the tip of an item to be smoked, comprising:

a mouthpiece formed of a single piece of material having a length of 39.5 mm, and having a first mouthpiece section defining a length of 19.5 mm, and having a concaved top side and a concaved bottom side, and a second mouthpiece section defining a length of 20 mm and having a tube shape, the first mouthpiece section including a first passageway section and a first portion of a second passageway section next to the first passageway section, and the second mouthpiece section having a second portion of the second passageway section;

wherein the first passageway section has a first, tubular passageway with a length of 15.5 mm and a diameter of 3.5 mm;

wherein the first portion of the second passageway section is conical and has a length of 4 mm and a diameter of 9 mm at an end proximate to the first passageway;

wherein the second portion of the second passageway section is conical and has a length of 20 mm and a diameter of 13.5 mm at an end opposite the end proximate to the first passageway;

wherein the mouthpiece is configured to hold an item to be smoked having a tip ranging from 9 mm wide to 13.5 mm wide.

6. A device for holding the tip of an item to be smoked, comprising:

a mouthpiece formed of a single piece of material having a length of 39.5 mm, and having:

a first mouthpiece section defining a length of 19.5 mm, and having a concaved top side, a concaved bottom side, a tubular first passageway section having a length of 15.5 mm and a diameter of 3.5 mm, and a first portion of a linearly conical second passageway section, the first portion having a length of 4 mm; and a tubular second mouthpiece section having a length of 20 mm, and having a second portion of the linearly conical second passageway section, the second portion having a length of 20 mm;

wherein the linearly conical second passageway has a total length of 24 mm;

wherein the linearly conical second passageway section has a diameter sloping linearly from 9 mm at the tubular first passageway section to 13.5 mm at an end of the second mouthpiece section.

* * * * *